US010869119B2

(12) United States Patent
Lawand et al.

(10) Patent No.: US 10,869,119 B2
(45) Date of Patent: Dec. 15, 2020

(54) SOUND CHANNEL ELEMENT WITH A VALVE AND A TRANSDUCER WITH THE SOUND CHANNEL ELEMENT

(71) Applicant: Sonion Nederland B.V., Hoofddorp (NL)

(72) Inventors: Nishant Lawand, Hoofddorp (NL); Caspar Titus Bolsman, Hoofddorp (NL); Laurens de Ruijter, Hoofddorp (NL); Petrus Egbertus Henricus Hermsen, Hoofddorp (NL); Erik Marinus Krom, Hoofddorp (NL); Theodorus Geradus Maria Brouwer, Hoofddorp (NL); René Maas, Hoofddorp (NL); Umut Tabak, Hoofddorp (NL)

(73) Assignee: SONION NEDERLAND B.V., Hoofddorp (NL)

( * ) Notice: Subject to any disclaimer, the term of this patent is extended or adjusted under 35 U.S.C. 154(b) by 0 days.

(21) Appl. No.: 16/160,214

(22) Filed: Oct. 15, 2018

(65) Prior Publication Data

US 2019/0116416 A1 Apr. 18, 2019

(30) Foreign Application Priority Data

Oct. 16, 2017 (EP) ..... 17196715

(51) Int. Cl.
*H04R 1/28* (2006.01)
*H04R 1/10* (2006.01)

(52) U.S. Cl.
CPC ..... *H04R 1/2857* (2013.01); *H04R 1/1041* (2013.01); *H04R 2460/11* (2013.01)

(58) Field of Classification Search
CPC .. H04R 25/604; H04R 25/65; H04R 2460/11; H04R 1/1016
See application file for complete search history.

(56) References Cited

U.S. PATENT DOCUMENTS

| | | | |
|---|---|---|---|
| 4,893,655 | A | 1/1990 | Anderson |
| 5,222,050 | A | 6/1993 | Marren et al. |
| 5,984,269 | A | 11/1999 | Short, III |
| 6,512,435 | B2 | 1/2003 | Van Namen |
| 6,549,635 | B1 | 4/2003 | Gebert |
| 6,639,496 | B1 | 10/2003 | Van Namen |
| 6,788,796 | B1 | 9/2004 | Miles |

(Continued)

FOREIGN PATENT DOCUMENTS

| | | |
|---|---|---|
| EP | 1 840 869 A1 | 10/2007 |
| EP | 2071872 A1 | 6/2009 |

(Continued)

OTHER PUBLICATIONS

Extended European Search Report for Application No. EP 18200513.2, dated Feb. 22, 2019 (4 pages).

(Continued)

*Primary Examiner* — Sunita Joshi
(74) *Attorney, Agent, or Firm* — Nixon Peabody LLP

(57) ABSTRACT

A sound channel with a side opening which may be opened or closed by an electromagnetic actuator. The sound channel may remain open and may thus be used as a spout of a sound generator for e.g. a hearing aid, where the side opening may be used as a vent.

19 Claims, 14 Drawing Sheets

(56) References Cited

U.S. PATENT DOCUMENTS

Figure 1:
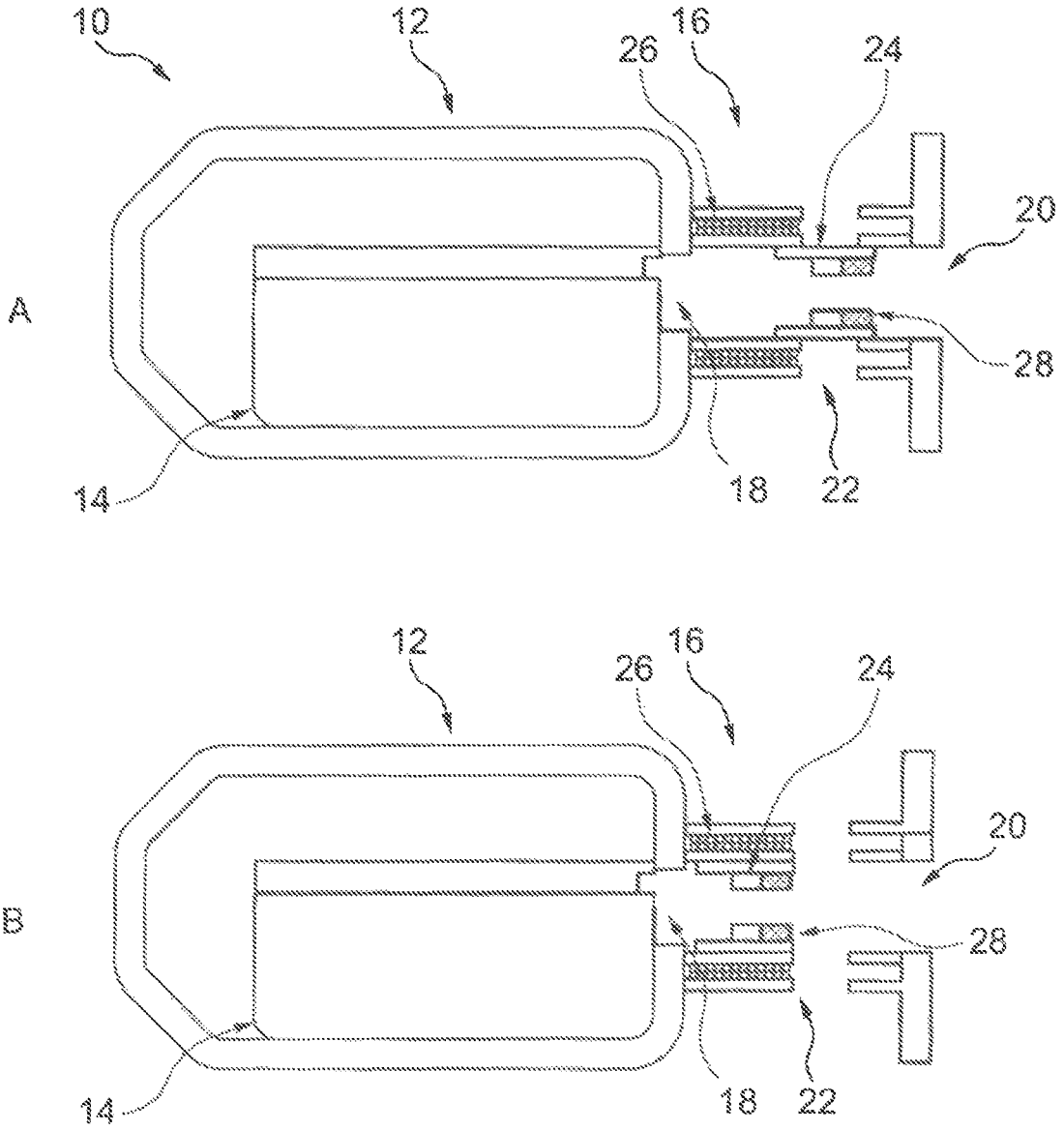

| | | | |
|---|---|---|---|
| 6,831,577 | B1 | 12/2004 | Furst |
| 6,853,290 | B2 | 2/2005 | Jorgensen |
| 6,859,542 | B2 | 2/2005 | Johannsen |
| 6,888,408 | B2 | 5/2005 | Furst |
| 6,914,992 | B1 | 7/2005 | van Halteren |
| 6,919,519 | B2 | 7/2005 | Ravnkilde |
| 6,930,259 | B1 | 8/2005 | Jorgensen |
| 6,943,308 | B2 | 9/2005 | Ravnkilde |
| 6,974,921 | B2 | 12/2005 | Jorgensen |
| 7,008,271 | B2 | 3/2006 | Jorgensen |
| 7,012,200 | B2 | 3/2006 | Moller |
| 7,062,058 | B2 | 6/2006 | Steeman |
| 7,062,063 | B2 | 6/2006 | Hansen |
| 7,072,482 | B2 | 7/2006 | Van Doorn |
| 7,088,839 | B2 | 8/2006 | Geschiere |
| 7,110,560 | B2 | 9/2006 | Stenberg |
| 7,136,496 | B2 | 11/2006 | van Halteren |
| 7,142,682 | B2 | 11/2006 | Mullenbom |
| 7,181,035 | B2 | 2/2007 | van Halteren |
| 7,190,803 | B2 | 3/2007 | van Halteren |
| 7,206,428 | B2 | 4/2007 | Geschiere |
| 7,221,767 | B2 | 5/2007 | Mullenbom |
| 7,221,769 | B1 | 5/2007 | Jorgensen |
| 7,227,968 | B2 | 6/2007 | van Halteren |
| 7,239,714 | B2 | 7/2007 | de Blok |
| 7,245,734 | B2 | 7/2007 | Niederdraenk |
| 7,254,248 | B2 | 8/2007 | Johannsen |
| 7,286,680 | B2 | 10/2007 | Steeman |
| 7,292,700 | B1 | 11/2007 | Engbert |
| 7,292,876 | B2 | 11/2007 | Bosh |
| 7,336,794 | B2 | 2/2008 | Furst |
| 7,376,240 | B2 | 5/2008 | Hansen |
| 7,403,630 | B2 | 7/2008 | Jorgensen |
| 7,415,121 | B2 | 8/2008 | Mögelin |
| 7,425,196 | B2 | 9/2008 | Jorgensen |
| 7,460,681 | B2 | 12/2008 | Geschiere |
| 7,466,835 | B2 | 12/2008 | Stenberg |
| 7,492,919 | B2 | 2/2009 | Engbert |
| 7,548,626 | B2 | 6/2009 | Stenberg |
| 7,657,048 | B2 | 2/2010 | van Halteren |
| 7,684,575 | B2 | 3/2010 | van Halteren |
| 7,706,561 | B2 | 4/2010 | Wilmink |
| 7,715,583 | B2 | 5/2010 | Van Halteren |
| 7,728,237 | B2 | 6/2010 | Pedersen |
| 7,809,151 | B2 | 10/2010 | Van Halteren |
| 7,822,218 | B2 | 10/2010 | Van Halteren |
| 7,899,203 | B2 | 3/2011 | Van Halteren |
| 7,912,240 | B2 | 3/2011 | Madaffari |
| 7,946,890 | B1 | 5/2011 | Bondo |
| 7,953,241 | B2 | 5/2011 | Jorgensen |
| 7,961,899 | B2 | 6/2011 | Van Halteren |
| 7,970,161 | B2 | 6/2011 | van Halteren |
| 8,098,854 | B2 | 1/2012 | van Halteren |
| 8,101,876 | B2 | 1/2012 | Andreasen |
| 8,103,039 | B2 | 1/2012 | van Halteren |
| 8,160,290 | B2 | 4/2012 | Jorgensen |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman |
| 8,233,652 | B2 | 7/2012 | Jorgensen |
| 8,259,963 | B2 | 9/2012 | Stenberg |
| 8,259,976 | B2 | 9/2012 | van Halteren |
| 8,259,977 | B2 | 9/2012 | Jorgensen |
| 8,280,082 | B2 | 10/2012 | van Halteren |
| 8,284,966 | B2 | 10/2012 | Wilk |
| 8,313,336 | B2 | 11/2012 | Bondo |
| 8,315,422 | B2 | 11/2012 | van Halteren |
| 8,331,595 | B2 | 12/2012 | van Halteren |
| 8,369,552 | B2 | 2/2013 | Engbert |
| 8,379,899 | B2 | 2/2013 | van Halteren |
| 8,509,468 | B2 | 8/2013 | van Halteren |
| 8,526,651 | B2 | 9/2013 | Lafort |
| 8,526,652 | B2 | 9/2013 | Ambrose |
| 8,798,304 | B2 | 8/2014 | Miller |
| 2009/0285437 | A1 | 11/2009 | Takigawa et al. |
| 2010/0061582 | A1* | 3/2010 | Takigawa ..... H04R 1/1041 381/380 |
| 2010/0061852 | A1 | 3/2010 | Takigawa et al. |
| 2011/0129108 | A1* | 6/2011 | Miller ..... H04R 1/326 381/322 |
| 2011/0182453 | A1 | 7/2011 | van Hal |
| 2011/0189880 | A1 | 8/2011 | Bondo |
| 2011/0268292 | A1* | 11/2011 | Suvanto ..... H04R 3/005 381/92 |
| 2011/0299708 | A1 | 12/2011 | Bondo |
| 2011/0299712 | A1 | 12/2011 | Bondo |
| 2011/0311069 | A1 | 12/2011 | Ambrose |
| 2012/0014548 | A1 | 1/2012 | van Halteren |
| 2012/0027245 | A1 | 2/2012 | van Halteren |
| 2012/0140966 | A1 | 6/2012 | Mocking |
| 2012/0155683 | A1 | 6/2012 | van Halteren |
| 2012/0155694 | A1 | 6/2012 | Reeuwijk |
| 2012/0255805 | A1 | 10/2012 | van Halteren |
| 2013/0028451 | A1 | 1/2013 | de Roo |
| 2013/0136284 | A1 | 5/2013 | van Hal |
| 2013/0142370 | A1 | 6/2013 | Engbert |
| 2013/0163799 | A1 | 6/2013 | Van Halteren |
| 2013/0195295 | A1 | 8/2013 | van Halteren |
| 2014/0169603 | A1 | 6/2014 | Sacha |
| 2014/0305735 | A1 | 10/2014 | Van Halteren |
| 2016/0255433 | A1 | 9/2016 | Grinker |
| 2017/0208382 | A1 | 7/2017 | Grinker |
| 2017/0251292 | A1 | 8/2017 | Wiederholtz |

FOREIGN PATENT DOCUMENTS

| | | | |
|---|---|---|---|
| EP | 2134107 | A2 | 12/2009 |
| EP | 2164277 | A2 | 3/2010 |
| EP | 2345259 | A2 | 7/2011 |
| EP | 2 747 455 | A2 | 6/2014 |
| EP | 3177037 | A2 | 6/2017 |
| WO | WO 2010/042613 | A2 | 4/2010 |
| WO | 2014/030998 | A1 | 2/2014 |
| WO | WO-2014030998 | A1 * | 2/2014 ..... H04R 1/1091 |
| WO | 2019052714 | A1 | 3/2019 |
| WO | 2019052715 | A1 | 3/2019 |

OTHER PUBLICATIONS

Partial European Search Report for Application No. EP 18200516, dated Feb. 20, 2019 (5 pages).

Cox, R.M.; "Acoustic aspects of hearing aid-ear canal coupling systems"; Monographs in Contemporary Audiology, vol. 1, No. 3, pp. 1-44; Mar. 1, 1979; XP007905558 (48 pages).

* cited by examiner

A

B

SOUND CHANNEL ELEMENT WITH A VALVE AND A TRANSDUCER WITH THE SOUND CHANNEL ELEMENT

The present invention relates to a sound channel with a valve configured to close a side opening in the sound channel.

Sound valves and valves in general may be seen in US2011/0129108, US2017/0251292, US2014/0169603, U.S. Pat. Nos. 5,984,269, 6,639,496, 8,798,304, 6,512,435, 6,549,635, US2016/0255433, US2017/0208382, EP2164277, WO2010/042613, EP3177037 and U.S. Pat. No. 4,893,655.

Sound valves are mostly configured to open or close a sound path but are not used for closing a side opening in an otherwise open sound channel used for carrying sound which the valve is not to influence.

In a first aspect, the invention relates to a sound channel element having a sound channel comprising a first sound opening and a side opening between the first and second openings and a closing element configured to move between a first position in which the closing element leaves the side opening open and with a cross sectional area of at least 1 $mm^2$, and a second position wherein the closing element blocks the side opening, the sound channel comprising an electromagnetic actuator for positioning the closing element in the first and second positions, respectively.

In the present context, the sound channel element may comprise one or more elements which together form the sound channel which preferably has only the first opening and the side opening. Actually, the sound channel may have also a second opening to be configured to transport sound from the first opening to the second opening, where sound may exit or enter the sound channel via the side opening.

A sound opening may be an opening to surroundings of the sound channel element or an opening into another element, such as a sound emitter or a sound detector, a sound guide, or the like.

The side opening preferably is an opening from the sound channel in the sound channel element and to surroundings of the sound channel element. Thus, the side opening may itself be a sound channel through a wall of the sound channel element. When the second opening is also provided, the side opening usually is positioned between the first and second openings so that sound entering the sound channel via the first opening may exit the side opening without reaching the second opening. The position of the side opening may be a position of an opening thereof into the sound channel. Thus, "between" will be along the path sound will take when travelling from the first to the second opening.

The closing element is configured to be in each of first and second positions, so that the closing element may be in either position but is capable of being in both positions, such as sequentially one after the other. Often, the closing element will, over time, toggle between the first and second positions in order to sequentially achieve the advantages of the closed side opening and the open side opening.

In the present context, "open" and "closed" or "blocked" may depend on the circumstances. When sound is controlled or blocked, the side opening need not be hermetically closed, as sound may be sufficiently attenuated even if the side opening still has a small opening. In this context, "open" and "closed"/"blocked" may, for sound control, be defined to a desired degree of sound attenuation and/or in relation to a minimum and maximum size of the side opening when closed or not closed by the closing element.

"Closed"/"blocked" may mean that all frequencies within a predetermined interval, such as 20 Hz-20 kHz, 200-3000 Hz, 100-10,000 Hz, 200-5000 Hz, 400-4000 Hz or 700-2000 Hz are attenuated at least 3 dB, such as at least 6 dB, such as at least 10 dB, such as at least 30 dB. "Closed" may additionally or alternatively mean that a cross sectional area of any opening between the closing element and the side opening has a cross section of no more than 0.157 $mm^2$, such as no more than 0.15 $mm^2$, such as no more than 0.125 $mm^2$, such as no more than 0.12 $mm^2$, such as no more than 0.1 $mm^2$, such as no more than 0.08 $mm^2$, such as no more than 0.05 $mm^2$, such as no more than 0.02 $mm^2$.

"Open" may mean that no frequency within a predetermined interval, such as 20 Hz-20 kHz, 200-3000 Hz, 100-10,000 Hz, 200-5000 Hz, 400-4000 Hz or 700-2000 Hz is attenuated more than 6 dB, such as no more than 3 dB, such no more than 2 dB. "Open" may additionally or alternatively mean that a cross sectional area of the side opening or a portion thereof not blocked by the closing element, is at least 1 $mm^2$, such as at least 1.2 $mm^2$, such as at least 1.5 $mm^2$, such as at least 2 $mm^2$, such as at least 2.2 $mm^2$, such as at least 2.5 $mm^2$, such as at least 3 $mm^2$, such as at least 4 $mm^2$, such as at least 5 $mm^2$.

The closing element is configured to close the opening or aperture when in the second position. Thus, the closing element is preferably configured to abut the side opening or a portion the sound channel adjacent to and/or defining the side opening at least at a large proportion of a circumference of the side opening, such as at at least substantially the entire circumference of the side opening.

Often, the closing element is a separate element which may be moved/translated/rotated in relation to the sound channel element. In one embodiment, however, the sound channel element may be deformable, so that a portion of the sound channel element may be forced toward the side opening to close the side opening and thus form the closing element.

Naturally, the side opening may have any shape, such as oval, circular, square or the like. Usually, a single side opening is provided, but any number of side openings may be provided, where the closing element then may be configured to block or close all side openings when in the second position. A side opening may be formed in a straight or plane portion of the sound channel element, such as a wall or plane surface. Alternatively, the side opening may be provided in a bent or curved portion of the sound channel element, such as in a wall of a tube-shaped portion. Then, the closing element should be shaped to conform to at least substantially that shape in order to be able to close the side opening sufficiently.

In the first position, the closing element does not close the side opening. Depending on the requirements, the closing element may still cover the side opening completely, partially or not at all. Additional positions of the closing element may be defined in which the side opening is only partially closed if desired.

The closing element may be movable, such as translatable, rotatable, bendable or combinations thereof in order to transfer from the first to the second position or vice versa. Often, the first and second positions are positions at different positions along a longitudinal direction of the sound channel, so that a simple translation along the longitudinal direction may transfer the closing element from the first to the second position and vice versa. Naturally, the movement may be in any direction, such as perpendicular to the longitudinal direction of the sound channel or around the longitudinal direction if desired.

A translation along the longitudinal axis has the advantage that the closing element need not take up much space in the sound channel neither in the open nor in the closed position. For example, if the sound channel has the same cross section over the distance along which the closing element is translated/rotated, the closing element will present the same narrowing of the sound passage irrespective of its position. Thus, the translation of the closing element does not to any significant degree alter the acoustic properties of the sound channel. The closing element may be slim and have a shape adapted to the wall of the sound channel so that it takes up minimal space in the sound channel. Again, the space required by the closing element is merely translated in the sound channel. In no position during the translation will the closing element present a substantially larger cross section which would impact the sound transmission negatively. The same may be the case for a rotation around the longitudinal axis. Clearly, these two movements may be combined.

Another advantage is that such rotation/translation is that it may be performed over arbitrarily large distances or angles, especially if the sound channel or at least the portion thereof along which the closing element moves has the same cross section or shape. In that situation, in no position during the translation will the closing element alter the acoustic properties significantly more than in other positions. Then, the translation can be performed over arbitrary distances. Also, the closing element may have any size along the longitudinal direction so that it can close side openings of any size, which again facilitates transport of sound within the frequency band desired with a sufficiently low attenuation.

The actuator is electromagnetic, whereby it operates at least partly using magnetic forces. Usually, an electromagnetic drive has one or more magnets, electromagnets or permanent magnets. Usually, the actuator will have a controllable element generating a controllable magnetic field, such as an electromagnet or a coil. A simple drive is a coil outputting a field which makes a magnet displace in relation to the coil. Electromagnetic actuators have the advantage that they are easily controllable, do not require high voltages and do not emit sound or other fields to any significant degree.

Another advantage is that an electromagnetic drive may be bi-stable or multi-stable, as no force will be exerted on e.g. a permanent magnet, if the drive is electrically generated and not powered. The drive may be based on electrically creating a magnetic field causing movement of a magnet. When this magnetic filed is off, the magnet will not move.

Then, electromagnetic drives may be especially interesting for battery powered elements, such as hearing aids, hearables or the like.

The actuator has the function of bringing the closing element into the first position and/or the second position and preferably to move the closing element from the first position to the second position or vice versa.

In one embodiment, the closing element comprises an element movable within the sound channel. In this manner, no movable elements need be provided outside the sound channel element, which may keep the overall size of the sound channel element with the valve down. In one embodiment, building-in of the valve may increase the diameter only by a few percent.

In one embodiment, the actuator is configured to translate the closing element in a direction at an angle to a longitudinal direction of the sound channel. In this situation, the first and second positions may have different distances from an inner wall of the sound channel, where the second position often is abutting or close to the sound channel wall, where the first position may be a position with a larger distance from the inner sound channel wall.

The first and second positions may be at the same or at least substantially the same longitudinal position along the sound channel, so that the actuator moves the closing element in a direction more or less perpendicular to the longitudinal direction of the sound channel. Then, a piston-like operation is seen of the closing element.

In one embodiment, the closing element is shaped as a part of a tube and is movable along a longitudinal direction of the sound channel. In this situation, the first and second positions may be at different longitudinal positions along the longitudinal direction of the sound channel.

Preferably, the closing element has an outer shape corresponding to, such as is very close to or even abuts, an inner shape of the sound channel in order to be able to block the side opening when in the second position.

The closing element may extend all around the inner circumference of the sound channel in order to automatically remain in contact with the inner surface of the sound channel. Alternatively, the closing element need contact the sound channel only around a portion of the inner circumference. In that situation, the actuator may bias the closing element toward the side opening and the inner surface of the sound channel at least when in the second position.

In one embodiment, the sound channel has a circular cross section.

In one embodiment, the closing element is shaped as a part of a tube and is movable around a longitudinal direction of the sound channel. In this situation, the sound channel preferably has a circular cross section, and the closing element preferably has an outer circumference which, when projected on to a plane perpendicular to the longitudinal axis of the sound channel, is circular, so that rotation around the longitudinal axis is facilitated.

In general, a circular shape may be preferred for hearing devices with a valve that is intended for insertion fully or partially in an ear canal.

In that or another embodiment, a substantially rectangular shaped nozzle is provided with a rectangular sliding closing element, where the side opening is provided in a plane side of the nozzle and where the closing element then may be translated along this plane side.

In this situation, the closing element preferably has, in the second position, a portion blocking the side opening and, in the first position, an opening therein overlapping with the side. In the second position, the opening will then be rotated to another position within the sound channel away from the side opening. The opening may be a channel through the closing element or a notch or area from an edge of the closing element.

In one embodiment, at least a portion of the actuator is positioned within the sound channel and is configured to allow sound to pass through the sound channel from the first to the second opening. In this situation, the actuator, or at least a portion thereof, is not positioned at the outer side of the sound channel element. This reduces the overall space requirements thereof. Preferably, all of the actuator is provided in the sound channel and/or in the sound channel element. A portion of the actuator may be provided in the sound channel element and surrounding the sound channel.

Even though all of or a portion of the actuator is provided in the sound channel, this portion of the actuator is dimensioned, relative to the sound channel, so that sound may pass the actuator and thus move from the first to the second opening, maintaining the operation of the sound channel.

Then, the portion of the actuator provided inside the channel may have a cross sectional shape, when projected on to a plane perpendicular to a longitudinal axis of the channel at that position, of a donut, where the outer circumference preferably abuts or is adjacent to the channel wall, so that sound is allowed to pass through a centre portion of the portion of the actuator.

As mentioned, any portion of the actuator not provided within the sound channel is preferably positioned around the sound channel, such as within the sound channel element. Alternatively, the portion may be provided outside of the sound channel element, such as fastened thereto. Preferably, this portion is positioned within a distance of no more than 50% of a mean sound channel diameter from the sound channel element so as to not take up too much space.

In a particularly preferred embodiment, the actuator comprises one or more coils positioned around the sound channel and wherein the closing element comprises one or more magnets—or vice versa. In this situation, the coil(s) may be provided on the outside of or in the sound channel element. Naturally, the coil(s) may be provided in the sound channel if desired.

The magnet(s) preferably have a small distance to the coil(s) in order to be influenced as much as possible by the field created by the coil(s). Thus, the magnet(s) preferably are positioned very close to the inner wall surface of the sound channel, which again may risk blocking the sound channel. Thus, the magnet(s) preferably have an outer contour, in a plane perpendicular to the longitudinal axis of the sound channel, which lies within but corresponds closely to the inner contour of the sound channel in the plane. In that situation, the magnet(s) preferably have therein a channel allowing sound to pass from the first to the second opening. In this context, the magnet(s) has/have a corresponding shape, when the outer contour of the magnet(s) lies within the inner contour of the sound channel and when the cross-sectional area within the outer contour is 90% or more of a cross sectional area within the inner contour of the sound channel.

Multiple coils may be provided at different longitudinal positions of the sound channel in order to facilitate moving the closing element back and forth between the first and second positions. Alternatively, a single coil may be used, as a coil may attract a magnet and push the magnet away by controlling the direction of the current fed to the coil.

In one embodiment, the closing element comprises one or more first magnets and wherein the actuator further comprises one or more second magnets or magnetisable materials attached in relation to the sound channel and positioned at a position corresponding to that of a first magnet, when the closing element is in one of the first or second the position.

In this situation, the first magnet(s) may be as described above, such as with a channel and having a shape corresponding to the inner contour of the sound channel.

When a first magnet approaches a second magnet or magnetisable material, the first magnet may be attracted thereto. Thus, the interaction between the first magnet and the second magnet or magnetisable material may be a biasing toward the one position, so that when the closing element is sufficiently close to this position, this interaction may bring the closing element to this position. Thus, a stable position may be obtained which may be maintained by this interaction and thus without requiring energy.

Naturally, a magnet may be an electromagnet, but permanent magnets are preferred. A wide range of materials have magnetic properties, both metal, ceramics and the like.

It is noted that two magnets may attract each other if suitably oriented in relation to each other. However, a magnet will also be attracted to a magnetisable material, as the magnet will orient the dipoles of this material and thus create a magnet-like response from the material—whereby an attraction is obtained. In this context, the magnetisable material may be any material to which a magnet may attach itself, such as most metals, and some ceramics and in particular mu-metal, iron, steel or the like.

Naturally, the closing element may be brought out of this engagement by forcing it away from this position. Any type of actuator may be used for this, such as a coil or a balanced armature actuator.

Naturally, second magnets or magnetisable material may be provided—at different longitudinal positions along the sound channel so as to define multiple stable positions. Another desirable position would be that of the first magnet (s) when the closing element is in the other of the first and second positions.

Then, energy may be required only to move the closing element away from one position and sufficiently close to the other position for the interaction to take over and move the closing element the rest of the way to the other position.

In this situation, another advantage may be seen if the closing element is configured to move at least 2%, such as at least 3%, 4% or 5% of a distance from the first position to the second position, from the one position and in a direction opposite to a direction toward the other of the first and second positions. As the attraction caused by the interaction will depend only on the distance of the closing element from the one position and not on the direction from which the closing element approaches the position, the closing element may be allowed to move past the position, as the attraction is not infinite. Thus, the closing element may be allowed to "over shoot" the position and perform a pendulum-like movement resulting in the closing element resting in the desired position. However, to allow this movement, the closing element should be allowed to move past the position, so that no elements should exist which the closing element collides with during this movement. Depending on the size of the attraction, the friction between the closing element and the sound channel element and other factors, the closing element will "overshoot" a smaller or larger distance. If no physical stops are provided within this distance, the closing element will arrive in the desired position without such collisions.

This has a further advantage in that such collisions will create sound and/or vibrations which may be problematic or at least undesired.

As mentioned above, when the actuator comprises multiple second magnets or magnetisable materials each positioned at different positions along a longitudinal direction of the sound channel, multiple stable positions may be obtained.

In one situation, as mentioned, the second magnet or magnetisable material is a magnetisable material, such as a ferromagnetic or ferromagnetic material, such as a metal or alloy, such as comprising Fe, Ni, Co, Mn, or Cr, or their compounds, such as mu-metal or other soft metal. Also, cubic spinel ferrites may be used, such as $NiFe_2O_4$, $CoFe_2O_4$, $Fe_3O_4$ (or $FeO.Fe_2O_3$), $CuFe_2O_4$ etc. Actually, any material having a coercivity and/or for use as magnets or shielding may be used.

A particularly interesting embodiment is one having a plurality of side openings, the sound channel having a longitudinal axis and the side openings being provided at at least substantially the same longitudinal position. In this situation, the cross sectional area of the side opening will be the combined or added cross sectional area of all the side openings. A single opening with a very large cross sectional area may be difficult to close, and it may affect the structural strength, stiffness, shape stability or the like of the sound channel element. Providing multiple side openings, such as 2, 3, 4, 5, 6 or even more, has the advantage that a large cross sectional area may be provided without such disadvantages.

When the side openings are provided at the same longitudinal position, they may be closed by a single element, such as an element translatable along the longitudinal element, such as if the sound channel has an inner cross sectional shape, such as a circle, an oval, a square or the like, and where the closing element has an outer cross sectional shape corresponding to the inner cross sectional shape of the sound channel. Preferably, the closing element is close to, such as abuts or touches, the inner surface of the sound channel along at least substantially all of its circumference in order to be able to close the side openings sufficiently.

In one embodiment, one or more of the side openings is oblong and directed around a circumference of the sound channel, such as in a plan perpendicular to the longitudinal axis. In this manner, the opening may be rather large while existing over a limited distance along the longitudinal axis.

As mentioned, the multiple openings are provided at least substantially at the same longitudinal position. Preferably, all parts of the openings exist within a first and a second position along the longitudinal axis, such as when projected on to the longitudinal axis. Then, the closing element need only extend from the first to the second position in order to block all side openings. This need not be a large translation required in order to fully open or fully close the side openings, even though the side openings have rather large cross sectional areas.

It may be desired that, at the side openings, the side openings exist at at least 20%, such as at least 30%, such as at least 40%, such as at least 50%, such as at least 60%, such as at least 70% of a circumference of the sound channel. As a contrast to this, the openings may extend, along the longitudinal axis, only 20% or less, such as 15% or less, such as 10% or less than the circumference.

A second aspect of the invention relates to a sound generator comprising a sound emitter and a sound channel element according to the first aspect of the invention, the sound emitter being configured to emit sound into the sound channel via the first sound opening. In this aspect, the second opening often is present.

Naturally, all embodiments and considerations relating to the first aspect are equally valid in relation to the second aspect.

The sound generator is capable of emitting sound into the sound channel via the first opening and preferably out through the second opening, whereby the closing element and actuator are capable of letting this sound pass through the sound channel irrespective of the state or position of the closing element. Thus, if all of or a portion of the closing element and/or the actuator is provided in the sound channel, the channel will not be blocked.

This sound generator may be configured to, such as dimensioned to, be used in or at an ear or ear canal of a person. The sound generator may be or form part of a hearing aid or personal hearable, such as an ear bud or an ear phone. Naturally, the sound generator may comprise additional elements, such as batteries, microphones, processors, or the like. The sound generator may have an outer housing in which the sound channel element and the sound emitter are provided.

In such situations, the desired, overall shape of the sound generator is oblong, as a too wide element would not fit in an ear canal.

In one embodiment, the sound emitter is positioned between the sound channel and at least a portion of the actuator. Usually, the cross section of the sound emitter is larger than that of the actuator, which again is larger than that of the sound channel. Then, this portion of the actuator need not take up space at the sound channel but also does not add to the thickness of the sound generator which is usually defined by the sound emitter. This position of the actuator portion may add to the length, however, of the sound generator. Thus, the sound generator may be generally oblong and have a cross sectional area, perpendicular to the oblong direction, not much larger than that of the sound emitter, such as no more than 50% more, such as no more than 40% more, such as no more than 30% more, such as no more than 20% more, such as no more than 10% more. Then, a drive element may be used for transporting force from the activator portion to the closing element. This drive element may then extend around or inside the sound emitter.

The sound generator may have a sound output and first and a second, opposite side surface parts, the sound output being in the first surface part and being positioned so as to launch sound into the first sound opening. Then, the actuator portion may be at the second side surface.

In another embodiment, the actuator is provided, in the outer housing, at the sound channel, Again, it is desired that the outer housing is no more than the above cross section. In this situation, the actuator or a portion may be in the sound channel and/or portions thereof may be outside of the sound channel, such as in a portion of a housing defining the sound channel. However, as the cross sectional area required by the sound channel often may be rather low, this position of the actuator again need not add to the overall cross sectional area of the sound generator.

It is noted that in this embodiment, the sound generator usually will be configured to be positioned in the ear canal with the sound channel emitting sound toward the ear drum of the person. Often, a dome is provided at the inner portions of the sound generator, i.e. at the sound channel. A dome may be blocking sound, whereby it is an advantage to have the side opening in the sound channel portion closest to the dome, so that the sound passing through the side opening may pass the dome when the side opening is open. Also, the sound has to pass only a relatively short distance inside the sound channel before reaching the output of the sound generator. Sound from outside of the ear may then reach the side opening by travelling around the portion of the sound generator housing on the outer side of the dome.

Actually, it may be desired that, when the sound channel has a predetermined length, the distance from the second sound opening to the sine opening is no more than 605, such as no more than 50%, such as no more than 40%, such as no more than 30%, such as no more than 20%, such as no more than 10% of the predetermined distance.

In one embodiment, the sound channel has a first sound channel and a second sound channel, the first sound channel extending from the first sound opening to the second sound opening, whereas the second sound channel extends from the side opening to the second sound opening. In this manner, the sound from the first sound opening is not mixed with that from the side opening.

Naturally, the sound generator may have an outer housing in which the sound emitter is provided and which has opening into the sound channel.

The sound channel may extend between openings provided in an outer housing of the sound generator, such as openings provided on opposite side portions of this housing. The other opening of the sound generator may be provided in a side portion configured to be directed out of or away from an ear canal of a person, when the sound opening is configured to direct sound into the ear canal.

A third aspect of the invention relates to a method of opening or closing a sound channel comprising a first sound opening, a side opening and a closing element, the method comprising an actuator moving the closing element between a first position in which the closing element leaves the side opening open and a second position wherein the closing element blocks the side opening. Again, the second opening may be present and the side opening provided between the first and second openings.

Naturally, multiple positions may be provided so that a movement from the first position to the second position is via e.g. a third position or multiple other positions which may, for example, only partly close the opening.

Naturally, all aspects, embodiments and the like of the invention may be combined. Thus, the operation of the opening and closing may be as described above. Naturally, multiple positions of the closing element may define different degrees of openness of the side opening. Also, the above manner of arriving at stable positions using magnets/magnetisable material may be controlled using e.g. coils or other transducers to move the closing element away from one stable position to arrive in the vicinity of another stable position.

As described, the actuator may be bi-stable or multi-stable so that the moving step comprises supplying power to the actuator to facilitate the movement and subsequently cutting power to the actuator. This is especially interesting in battery-operated equipment.

A fourth aspect of the invention relates to a valve comprising:

an element defining an opening, a blocking element configured to be moved between:

a first position in which the blocking element blocks the opening and a second position in which the blocking element leaves the opening open, an actuator for moving the blocking element between the first and second positions, wherein:

the valve comprises means for biasing the blocking element toward one of the first and second positions and the blocking element is configured to move, from the one position and in a direction away from the other of the first position and the second position, at least a distance of 2% of a distance between the first and second positions.

Naturally, the element defining the opening may define multiple openings, such as 2 or 3 openings. The element may define a channel, such as a sound channel having at least 2 openings where one opening may be blocked by the blocking element. If 3 openings are provided, sound may be allowed to pass from one to the other independently of whether the third opening is closed or not, where the blocking element in the first opening blocks the third opening.

Above and below, a blocking element comprising a magnet where the valve comprises other magnet(s) and/or magnetisable materials are described for defining the stable positions.

Other types of biasing means may be a spring or resilient material. A spring may engage the blocking element when in a desired position so that movement in the direction of the spring will compress the spring and thus be counter-acted. Then, a magnetic biasing may be provided in the opposite direction to make the position stable.

In another situation, one of the element defining the opening and the blocking element may have an indentation into which a projection of the other of the element and the blocking extends, when the blocking element is in the desired position. This projection may be biased in the direction toward the indentation so as to make the position stable. The indentation may be rather shallow so that when the blocking element is close to the desired position, the projection is already in the indentation and will, due to a shape of the indentation, be biased in the direction of the desired position, as the indentation may be the lowest there.

Figure 2:
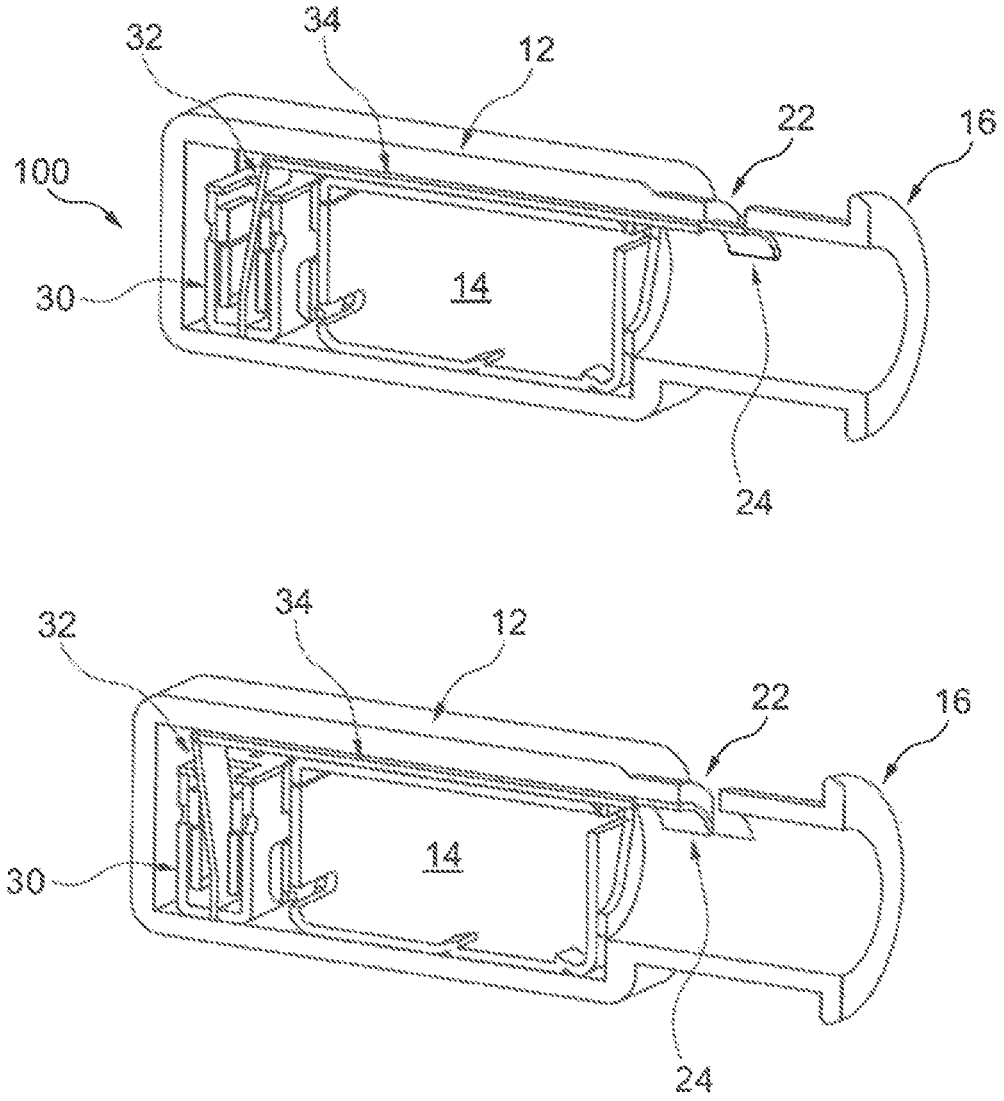
Figure 3:
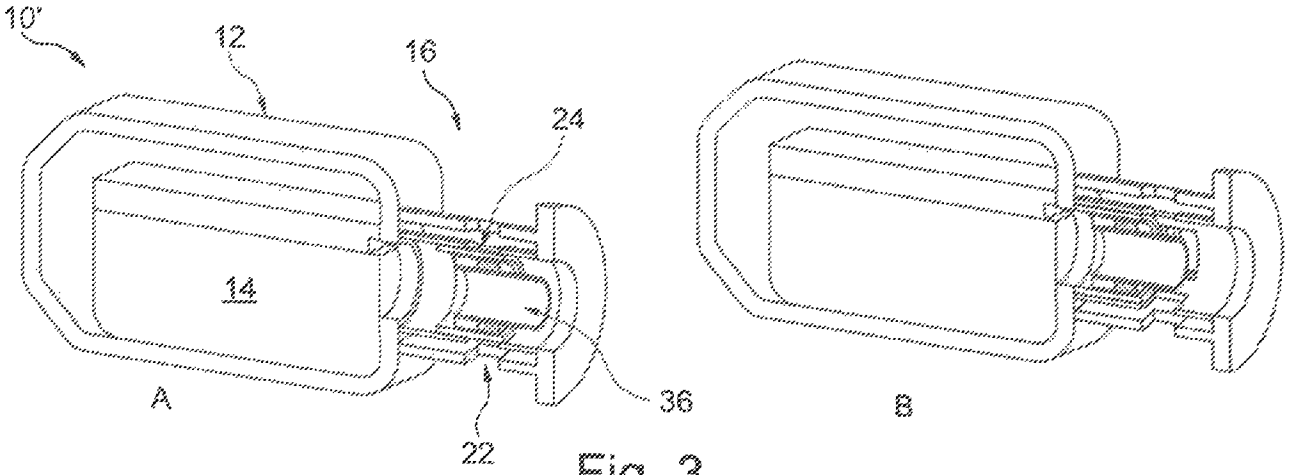
Figure 4:
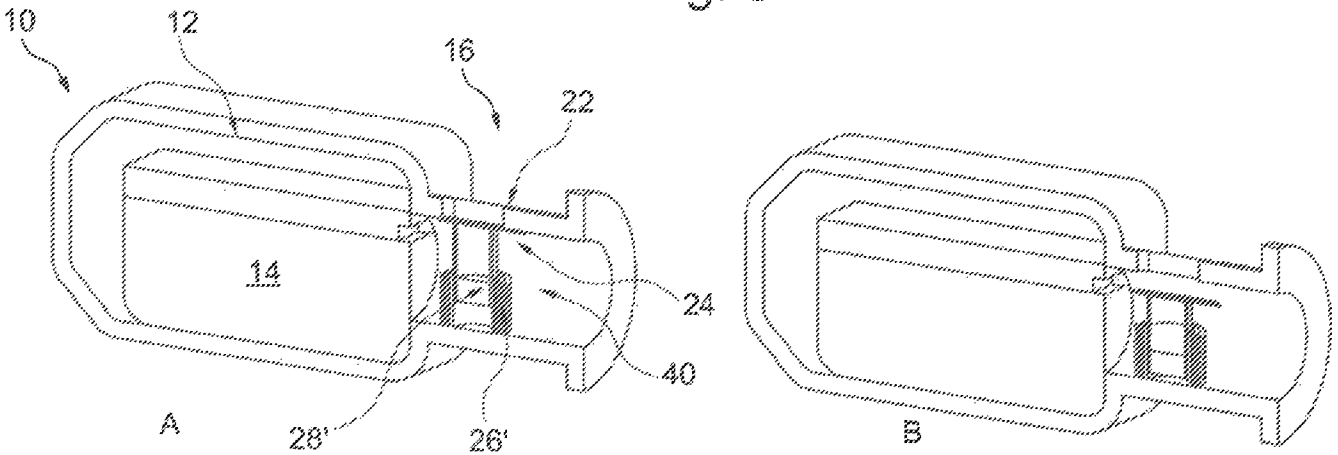
Figure 5:
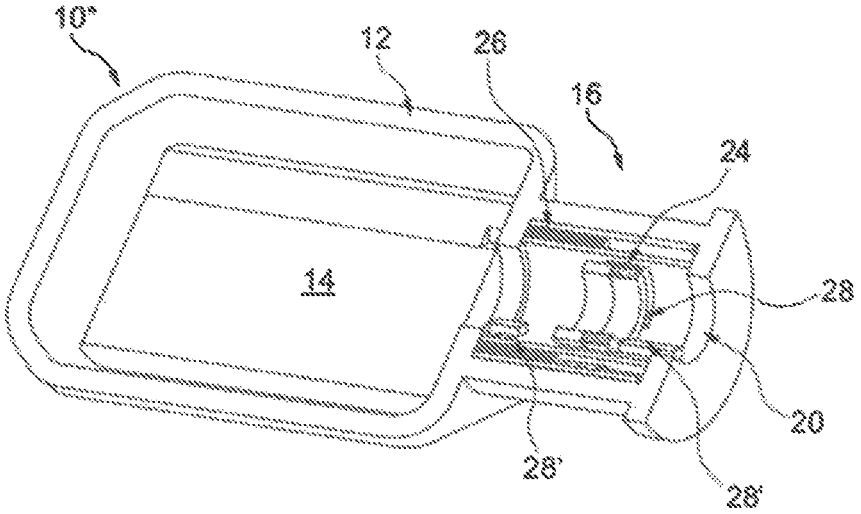
Figure 5:
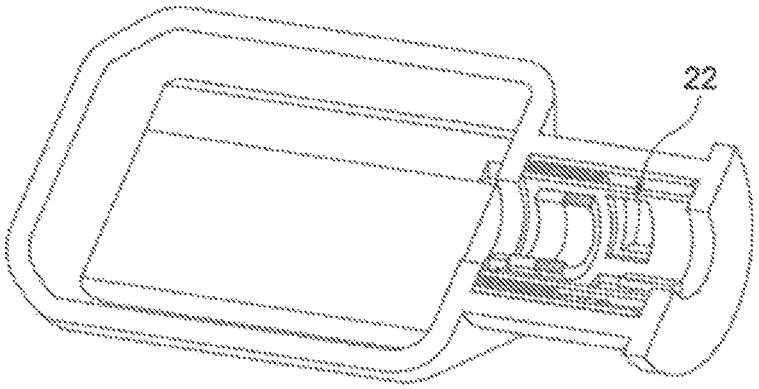
Figure 6:
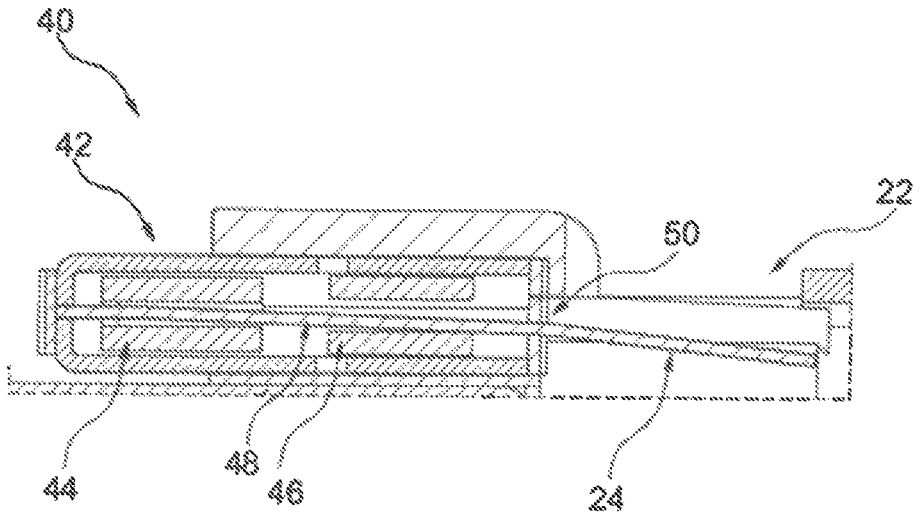
Figure 6:
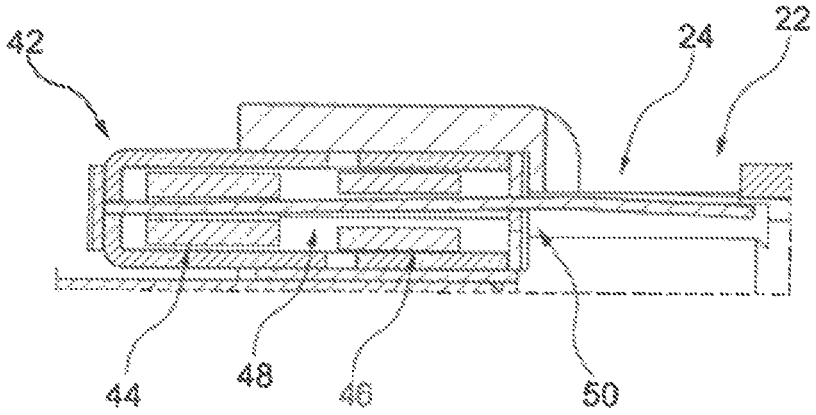
Figure 7:
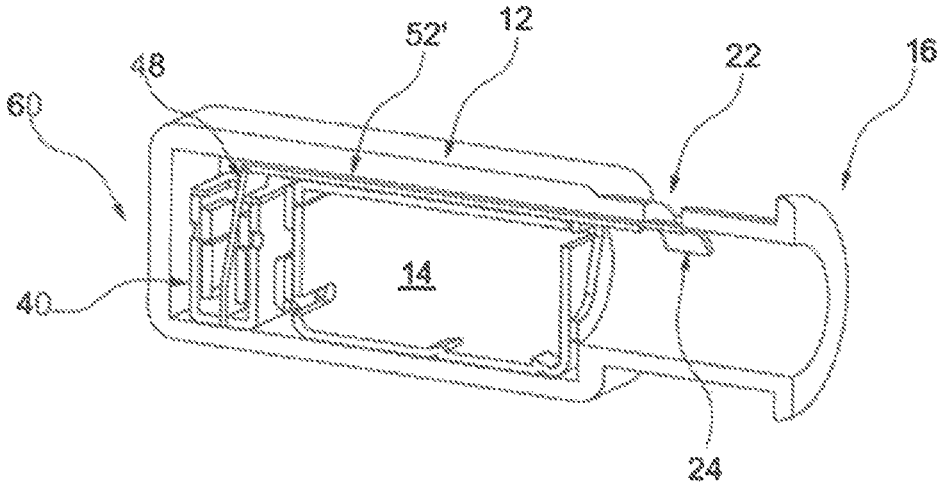
Figure 7:
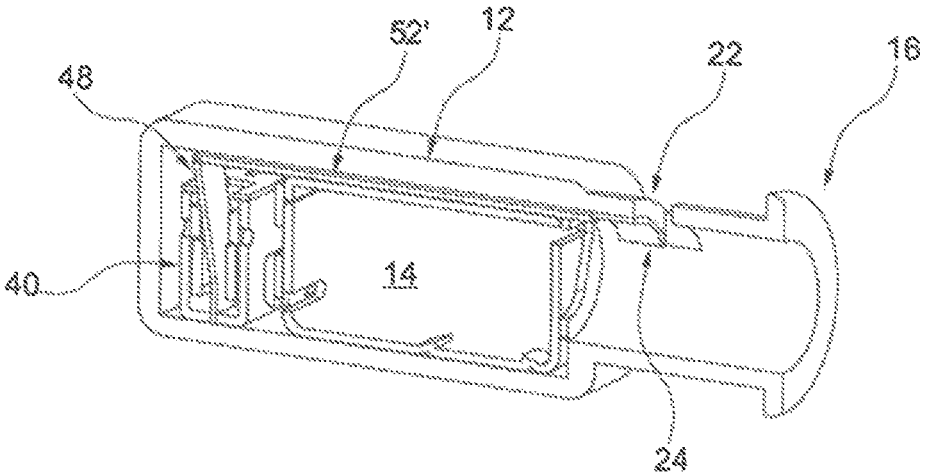
Figure 8:
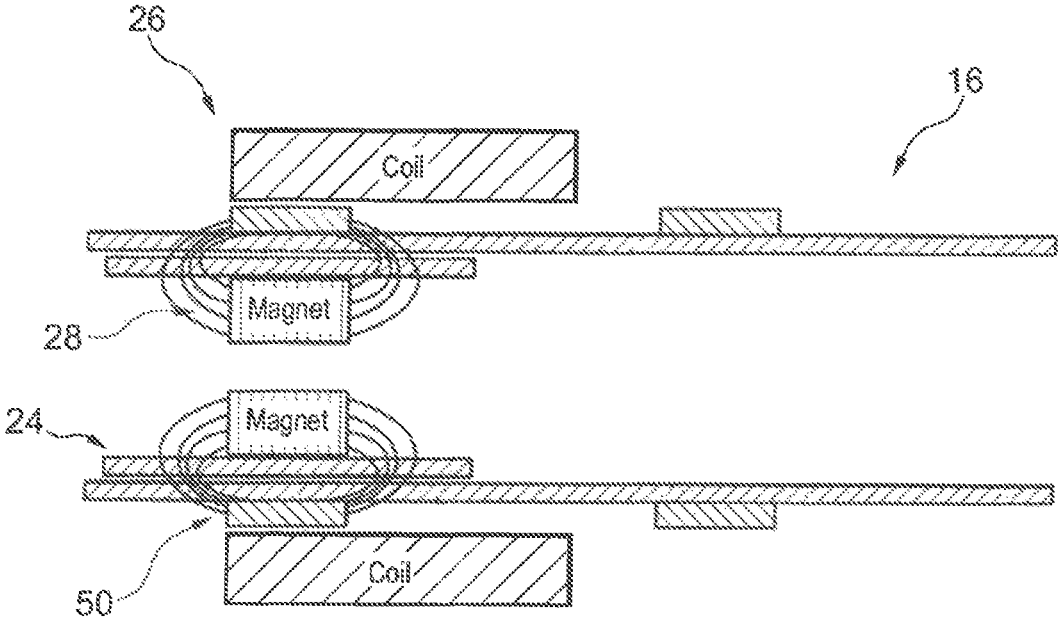
Figure 9:
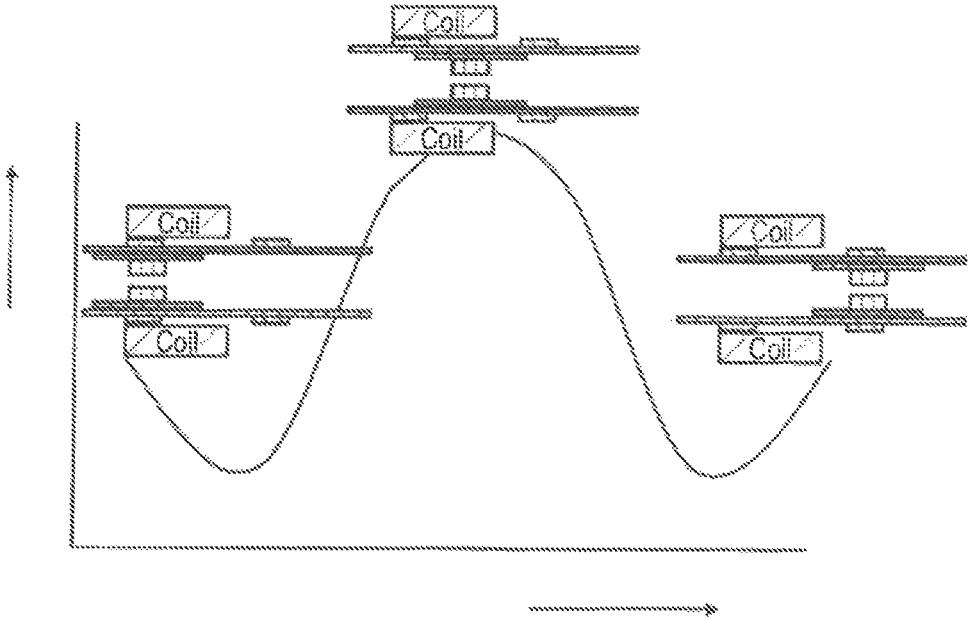

Generally, any type of push-pull mechanism may be used for defining the stable positions. In the following, preferred embodiments will be described with reference to the drawing, wherein:

FIG. 1 illustrates a sound generator comprising a first embodiment of a sound channel according to the invention, FIG. 2 illustrates a sound generator with a second embodiment of a sound channel according to the invention, FIG. 3 illustrates a sound generator with a third embodiment of a sound channel according to the invention, FIG. 4 illustrates a sound generator with a fourth embodiment of a sound channel according to the invention, FIG. 5 illustrates a sound generator with a fifth embodiment of a sound channel according to the invention, FIG. 6 illustrates a sixth embodiment of a sound channel according to the invention, FIG. 7 illustrates a sound generator with a seventh embodiment of a sound channel according to the invention, FIG. 8 illustrates a first embodiment of a sound channel with two magnetically defined, stable positions, FIG. 9 illustrates the magnetic, potential energy of the set-up of FIG. 8

Figure 10:
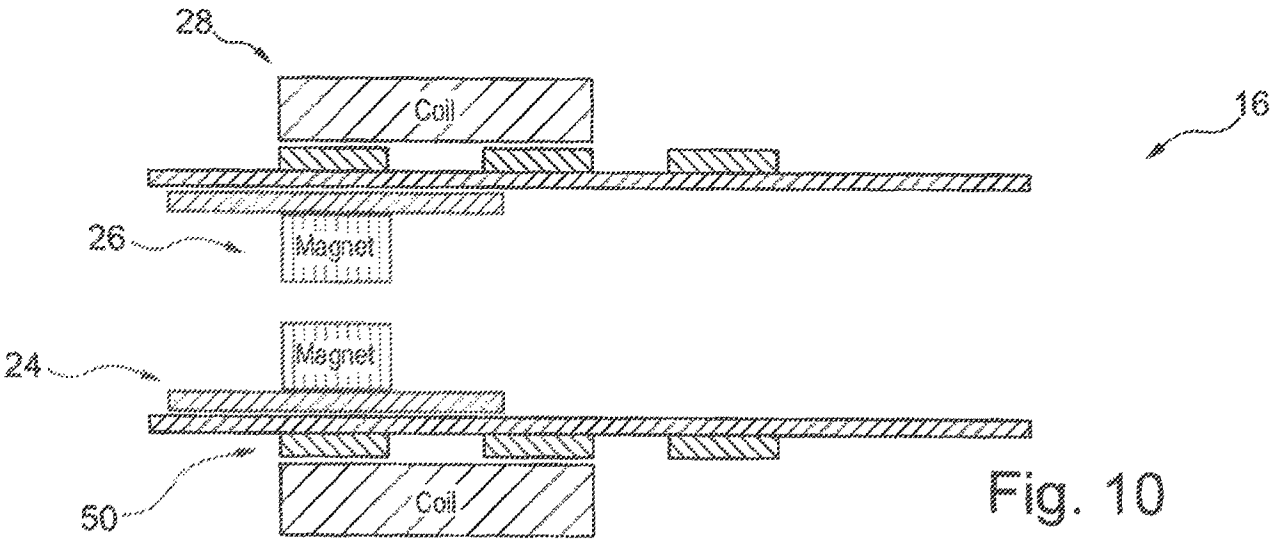
Figure 11:
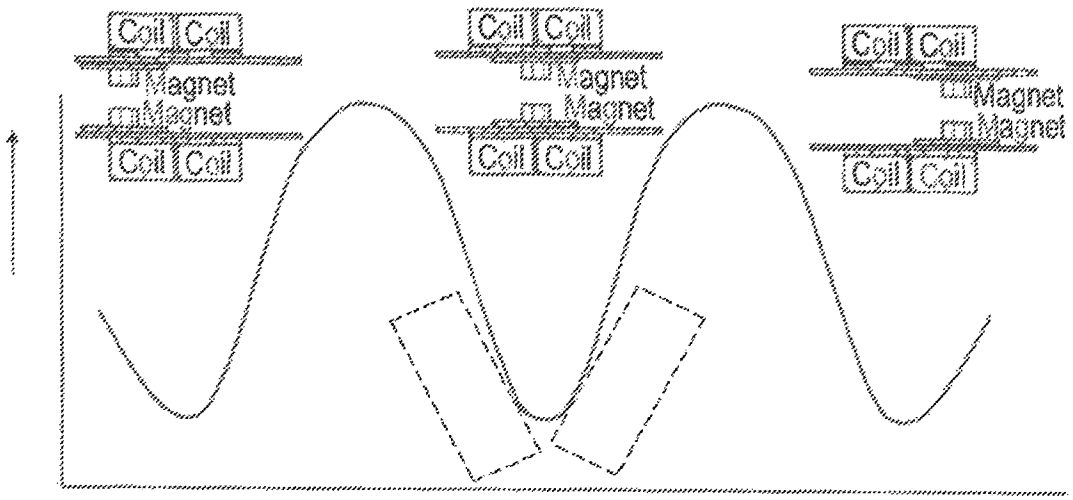
Figure 12:
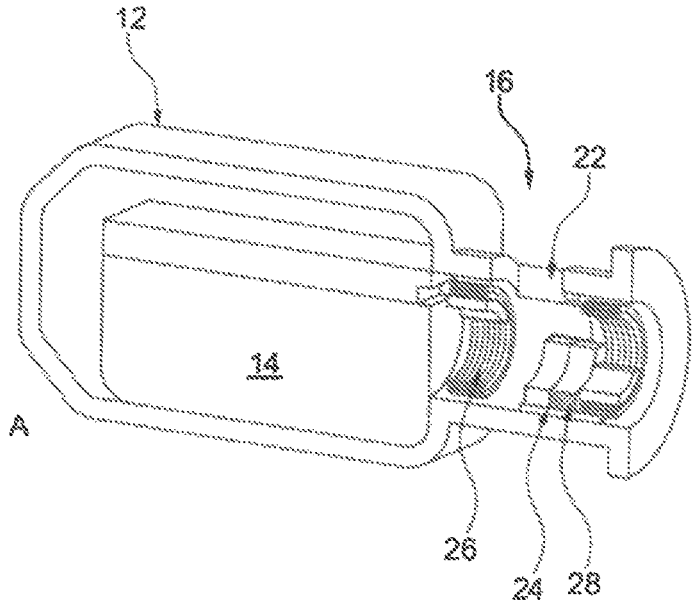
Figure 12:
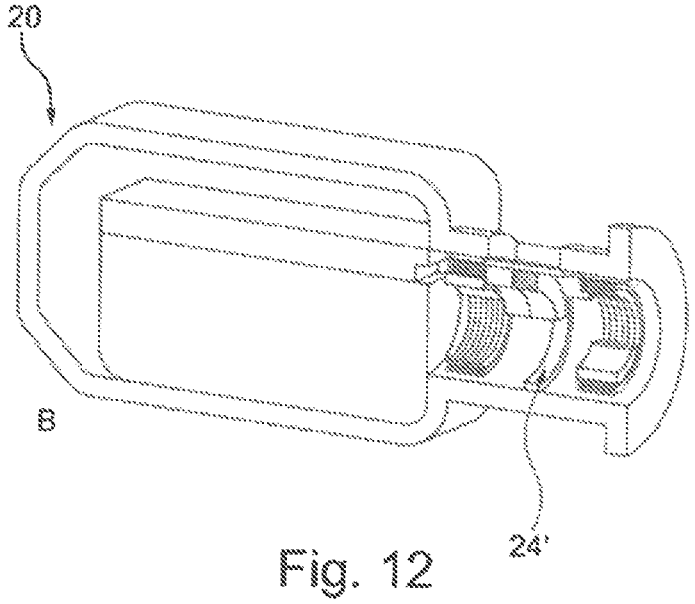
Figure 13:
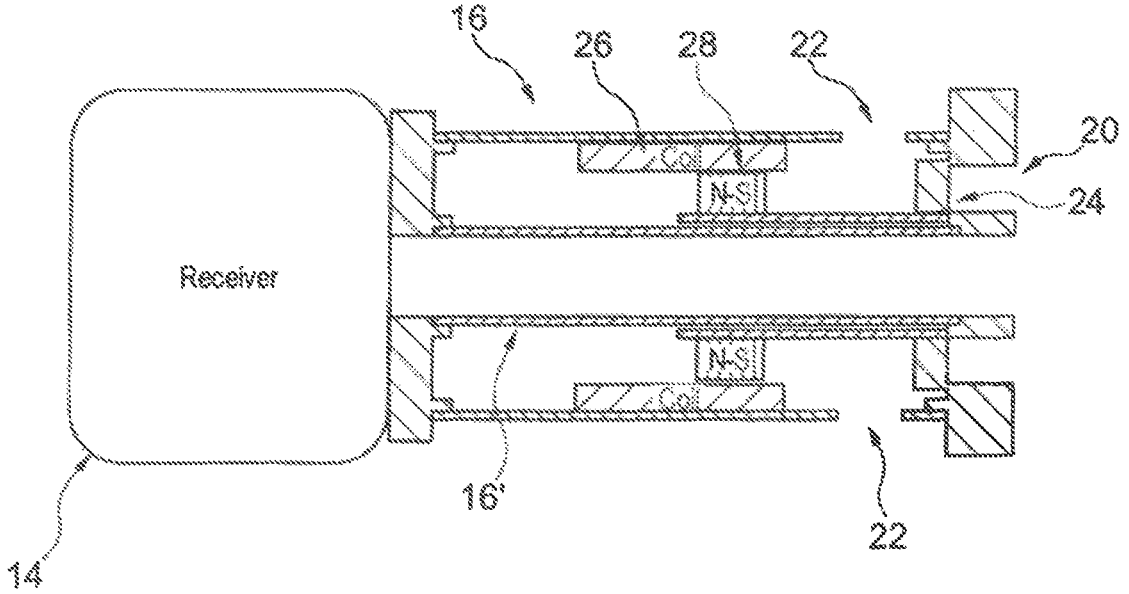
Figure 13:
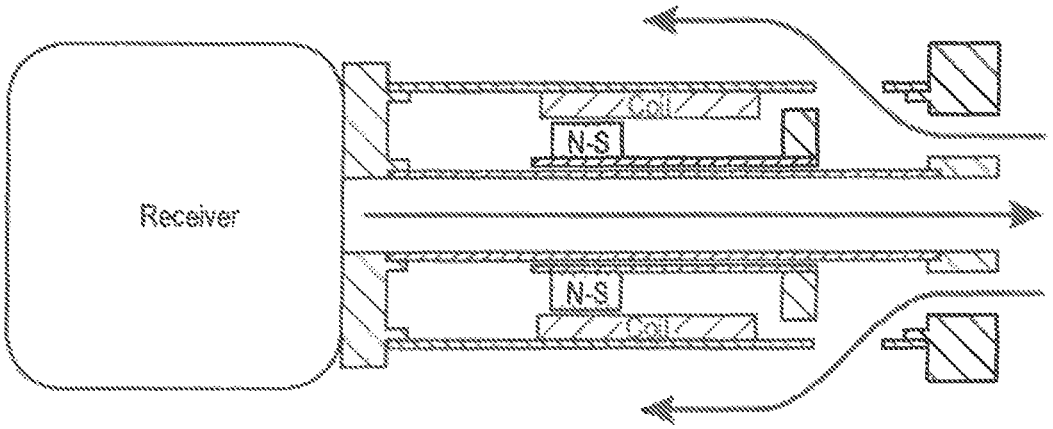
Figure 14:
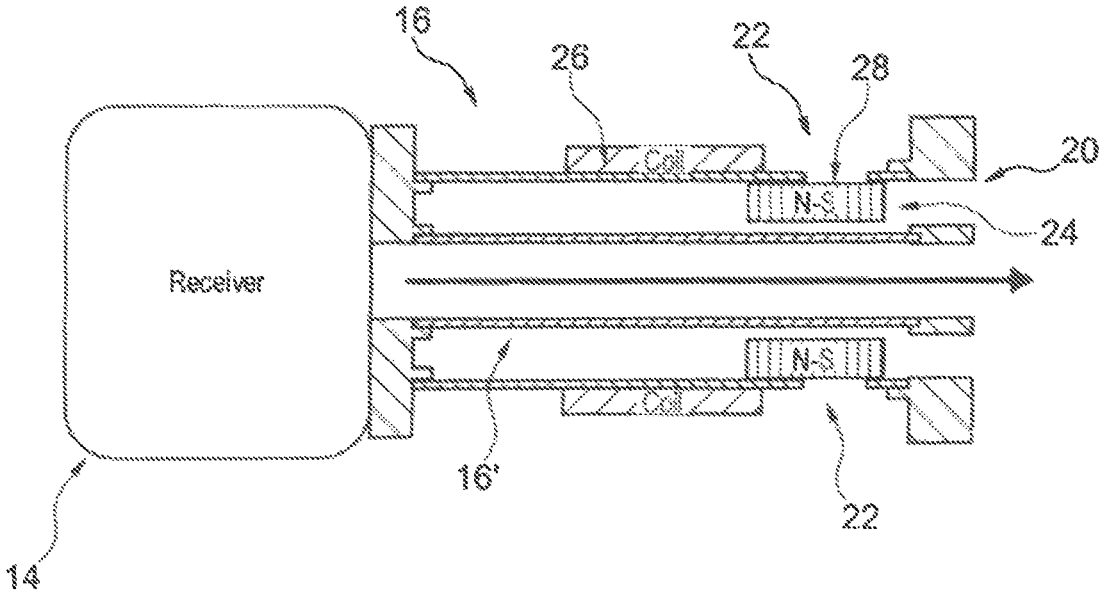
Figure 14:
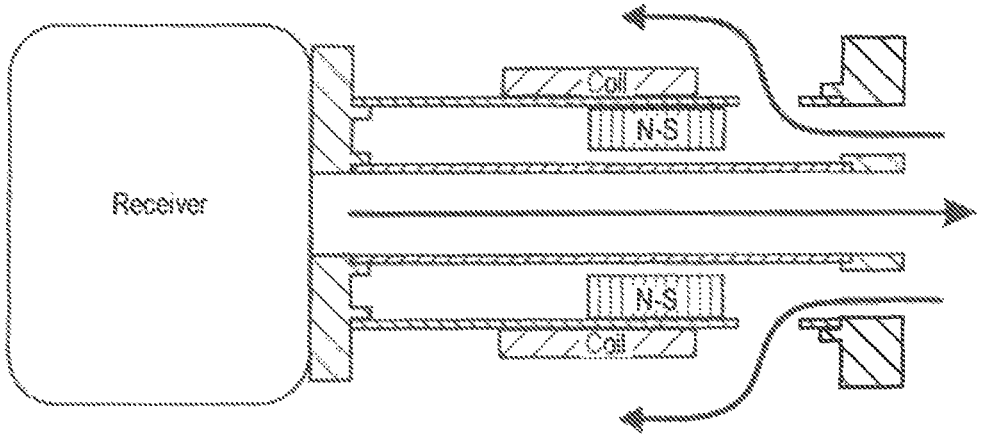
Figure 15:
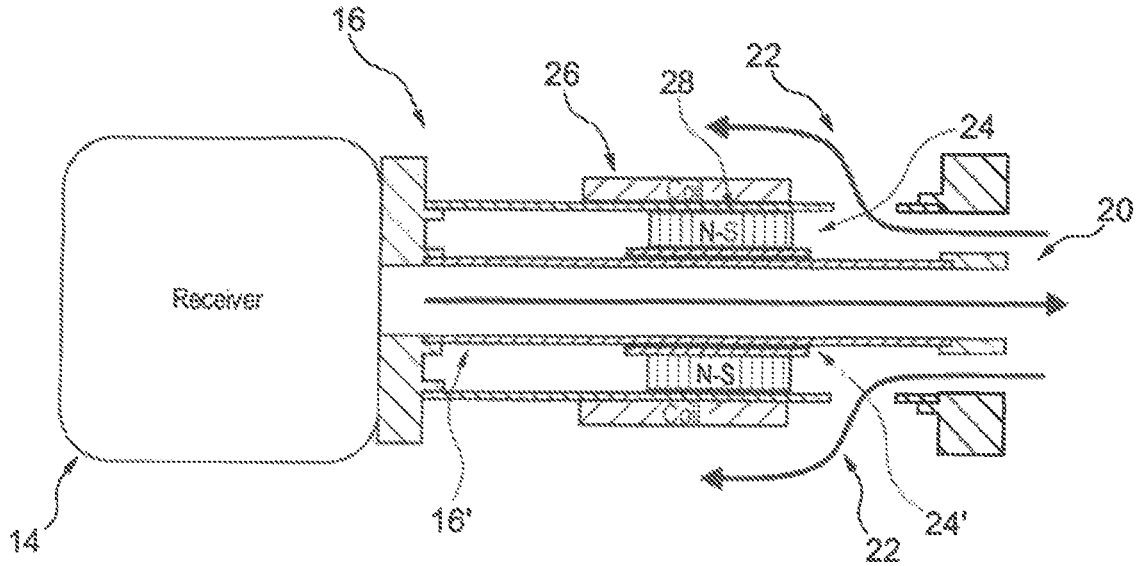
Figure 15:
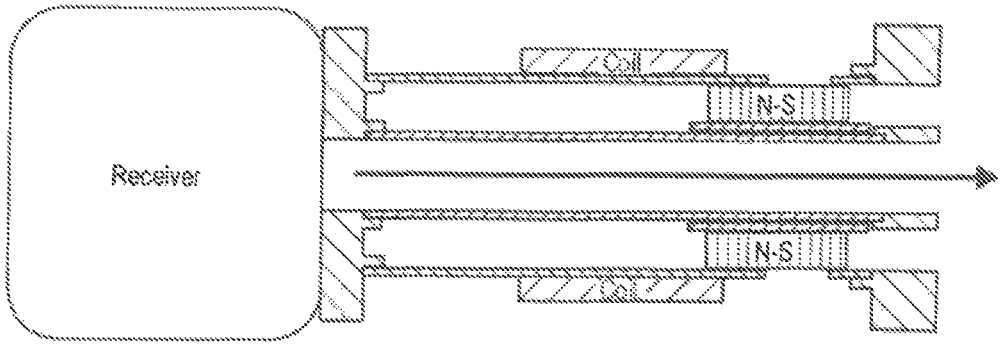
Figure 16:
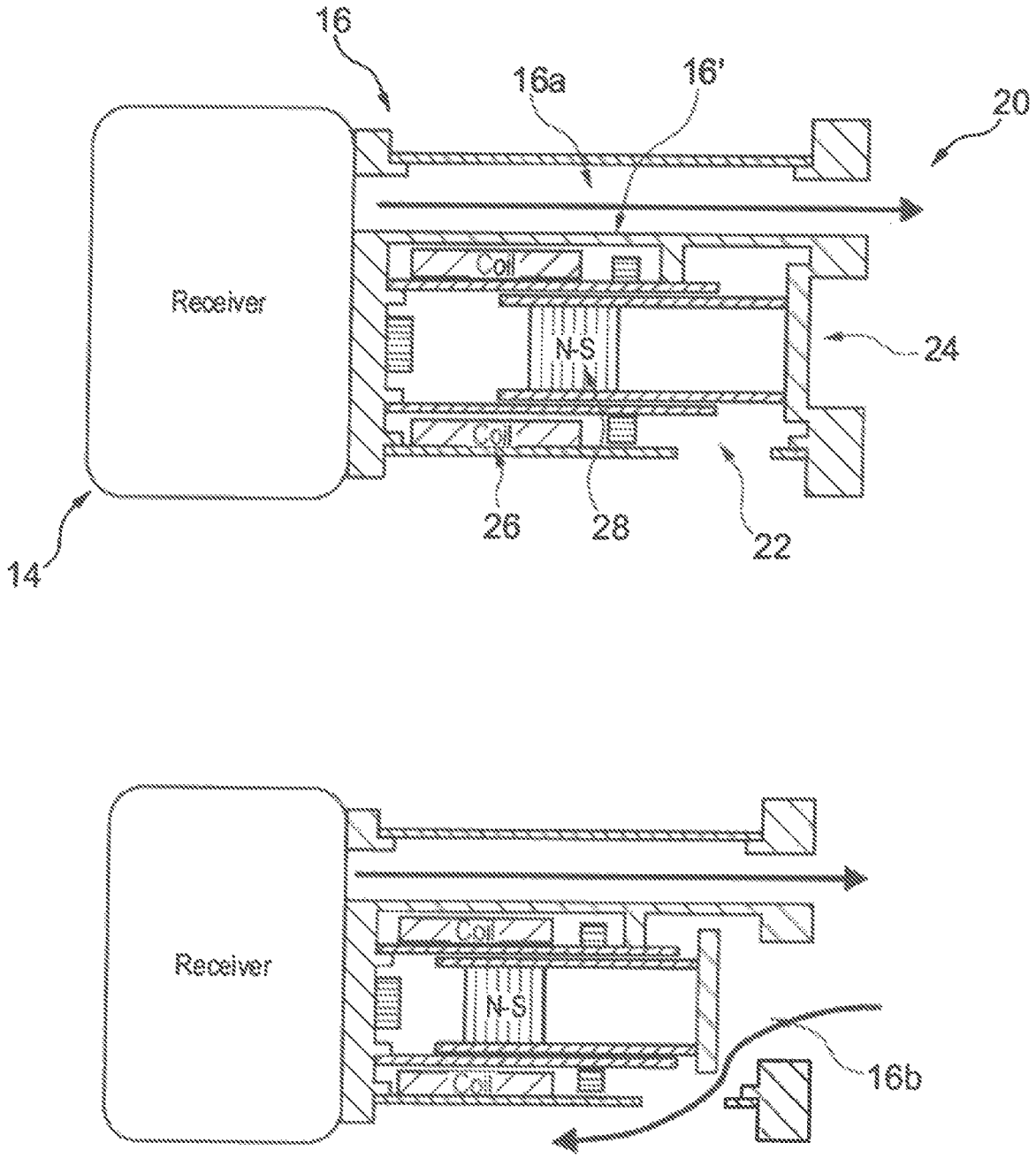
Figure 17:
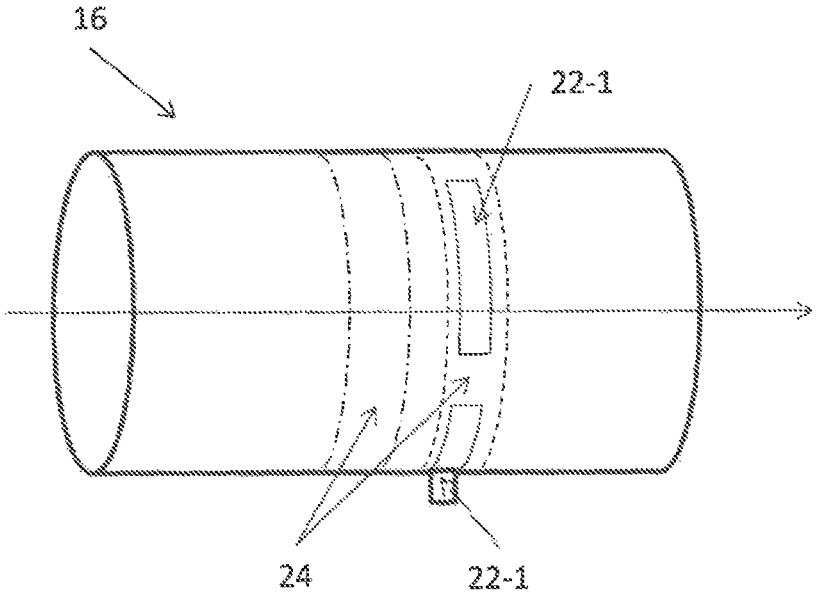

FIG. 10 illustrates a second embodiment of a sound channel with three magnetically defined, stable positions, FIG. 11 illustrates the magnetic, potential energy of the set-up of FIG. 10, FIG. 12 illustrates a sound generator with a eighth embodiment of a sound channel according to the invention, FIG. 13 illustrates a sound generator with a ninth embodiment of a sound channel according to the invention, FIG. 14 illustrates a sound generator with a tenth embodiment of a sound channel according to the invention, and FIG. 15 illustrates a sound generator with an eleventh embodiment of a sound channel according to the invention, FIG. 16 illustrates yet another example of a sound generator and FIG. 17 illustrates a sound channel with a preferred aperture shape.

In FIG. 1, a sound generator 10 is illustrated having an outer housing 12, a sound emitter 14 and a spout or nozzle 16 configured to receive sound emitted by the emitter 14. The spout 16 is elongate, has an opening 18 toward the housing 12 and an output opening 20 toward the surroundings for outputting sound received from the emitter 14. The spout may be configured to be connected to a sound guide for guiding sound to other elements. In one embodiment, the sound generator is for use in a hearing aid, hearing instrument, headset or hearable having an outer housing with a sound outlet which may be the output opening 20 or an output of an element connected to the spout.

The spout has a side opening 22 which may be closed by a blocking element 24 which may be positioned in a blocking position (see figure A) and an open position (see figure B) where, respectively, the blocking element 24 blocks the opening 22 and when it does not.

In the embodiment seen in FIG. 1, the blocking element is translatable along the longitudinal axis or direction of the spout.

The blocking element 24 is translated using an actuator comprising a coil 26 in or around the spout wall and a magnet 28 connected to the blocking element 24. The interaction of a magnetic field generated by the coil and the magnetization of the magnet will be able to translate the blocking element. It is noted that the magnet 28 has a channel there through so that the sound from the emitter 14 is capable of travelling along the spout and to the output 20.

In FIG. 2, another manner of driving the blocking element 24 of FIG. 1 is seen. In FIG. 2, some elements of FIG. 1 are left out to enhance the clarity.

In FIG. 2, the magnet/coil drive of FIG. 1 has been replaced by a so-called Balanced Armature actuator 30 having an armature 32 extending through a coil tunnel and a magnet gap and thus acts as a balanced armature receiver or an actuator as seen in US2017/0208382, US2016/0255433 and EP3177037 and Applicant's co-pending applications filed on even date and with the titles "A VALVE, A TRANSDUCER COMPRISING A VALVE, A HEARING DEVICE AND A METHOD" and "A PERSONAL HEARING DEVICE", which are hereby incorporated by reference. In this embodiment, the blocking element 24 is translated by the movement of the armature 32 of the actuator 30 via a drive pin 34, so that the actuator may be positioned e.g. behind the sound emitter.

In FIG. 3, an alternative to the embodiment of FIG. 1 is seen wherein some elements have been left out to enhance the clarity. In this embodiment, the blocking element 24 has an inner tube 36 which does not take part in the blocking of the side opening 22 but which extends in the longitudinal direction of the spout and which extends the path which sound emitted by the emitter 14 must travel to reach the opening 22 when the blocking element is in the open position (see figure B). In this manner, less sound emitted by the emitter is allowed to escape via the opening in the open position.

In FIG. 4, an alternative embodiment of a sound channel is illustrated in which a linear actuator 40 is positioned inside the spout 16. The actuator 40 has a fixed portion 26' with a coil and a movable portion 28' with a magnet and which is connected to the blocking element 24 which is shaped to close the opening 22 when in the closing (upper) position (see figure A). When in the lower position (see figure B), the opening 22 is open. it is seen that the sound from the emitter 14 is able to pass around the actuator 40 in both positions and above the blocking element 24 in the open position.

In FIG. 5, compared to FIG. 1, has the magnet 28 as the blocking member 24. Also, two magnetic members 28', such as magnets or magnetisable material, are provided for engaging the magnet 28 and attaching thereto by magnetic attraction, when the magnet 28 engages these elements 28'. The elements 28' are positioned so as to engage the magnet 28 when in the open and closed position, respectively.

In FIG. 6, a valve or actuator 40 is illustrated having a housing 42 with an opening 50. In the housing 42, an armature is provided having a deflectable armature leg 48 extending through a coil tunnel in a coil 44 and a magnet gap in a magnet system 46. The operation of the armature may be as that of balanced armature receivers or the valves seen in the above references, where the armature leg conducts a magnetic field generated by the coil into the magnet gap, where the armature leg is exposed to the magnetic field deflecting the armature leg upwardly or downwardly. In usual receivers, the deflection mirrors the current in order to generate sound, but in the present context, the armature movement is used for opening/closing a valve, so the signal fed to the coil usually is a constant current—or a current exceeding or being below a threshold, so that the armature is positioned in an upper or a lower position for opening/closing of the valve.

In some embodiments, the actuator is mono stable so that if no current is fed to the coil, the armature leg is biased toward a stable position, such as the lower or upper position. When a current fed to the coil exceeds a predetermined threshold, the force exerted to the armature leg may overcome the biasing and thus bring the armature leg to the other position. In this type of situation, the armature may be positioned at an angle so that the leg, when not affected by a magnetic field (the current fed to the coil is zero), is in the first position.

In another situation, the leg may be biased by any desirable biasing element, such as a magnetic/electric field, a spring or the like, toward the first position.

A bi stable actuator may be obtained when the armature leg, when touching the inner surface of the magnet gap at the upper and lower position, will be attracted to the magnet system to a degree overcoming any biasing caused by the deflection of the armature leg. Thus, when the leg is in the upper or lower position, it will stay in that position until an additional force, created by the magnetic field caused by a current fed to the coil, overcomes this attraction and forces the armature leg into the other position, where the leg again touches the magnet system and thus again is in a stable position.

Alternatively, of course, the actuator need not have any stable modes in the outer positions but require the feeding of a current to obtain both of these outer positions.

The armature and coil/magnet systems are provided in a housing 42 having an opening 50 from which a portion 24 of the armature leg 48 extends. Preferably, the housing 50 has no other opening than the opening 50, or at least no other opening suitable for transporting sound in the audible frequency range of 20 Hz-20 kHz—or at least in the interval of 700 Hz-2000 Hz. Openings of this type usually have a cross sectional area of 2.2 mm2 or more.

An aperture or side opening 22 is defined by an element, which aperture is blocked by the portion 24 in the lower illustration but kept open in the upper illustration. The remainder of the sound channel is left out, but generally, it extends below the side opening 22, such as in the plane of the illustration. Thus, a valve is created opening and closing the side opening 22 using the element 24. The element 24 may be made of the same material as the armature leg 48 or may be made of another material, such as a lighter material, a material not easily transporting a magnetic field, and/or a material providing a desired sealing to the element creating the aperture. Also, the material of the portion 24 may be selected to not provide a sound or vibration when colliding with the element forming the aperture when closing the aperture.

The portion 24 extends from the right-most portion of the armature leg 48 to obtain an even larger up/down deflection than the right-most portion of the armature leg 48. However, the portion 24 is bent slightly in order to conform to the element and thus the contour of the aperture 22.

In FIG. 7, a sound generator 60 is seen having an outer housing 12 with a spout or sound channel 16. A receiver 14 is provided configured to emit sound into the spout 16.

In the spout, a side opening or aperture 22 is provided having a closing mechanism, such as a flap or plate 24, which opens/closes the opening 22 and is controlled by a drive rod 52' connected to the armature leg 48. The drive rod 52' could be the extending portion 22 if desired. The flap or plate 24 is translate parallel to the channel wall and thus does not interfere excessively with sound output from the receiver 14.

Thus, the actuator is now positioned in a position further away from the actual valve or aperture while still being able to control it via the drive pin. Naturally, the opening/aperture 38 may be positioned in any desired position of the outer housing, including the spout, and the actuator may be positioned in any desired position, as a drive pin may be provided for conveying the movement of the armature leg to the closing mechanism.

In FIG. 8, a manner is illustrated of controlling not only the movement of the blocking elements 24 of FIGS. 1, 3 and 5, but more general setups, but also the positions in which the blocking element is maintained (in the open and closed positions) without providing mechanical stops defining these positions. Often, when an element has its movement stopped when colliding with a stopper, a sound and a vibration may be generated, which is not desirable.

In FIG. 8, only the relevant portions of the spout and actuator are illustrated, that is, the blocking element 24 with the magnet 28 and the spout 16 with the coil 26. In addition, two bands 50 of a magnetisable material (see above), such as mu-metal, are positioned at selected positions.

The operation of the bands 50 is that when the magnet 28 is close to a band 50, it will be magnetized by the magnet and thus attract the magnet 2286. Thus, the magnet 28 will be biased toward this position when the magnet is close to the band. In FIG. 6, two such positions are illustrated by the two bands 50.

Moving the blocking element 24 away from the illustrated position (to the right) will require exerting a sufficient force on the blocking element 24. This may be achieved by the coil 26—or by another type of translation such as that seen in FIG. 2.

Thus, the magnetic potential of positions between the two positions defined by the bands may be seen in FIG. 9, as a function of the longitudinal position of the blocking element 24 along the direction of movement, where it is seen that when the blocking element 24 has reached half way between the positions, it will be attracted to the other position and thus will automatically be brought to that position.

The same operation may be achieved by replacing the bands with magnets or coils fed a suitable current.

Naturally, the bands 50 need not stretch over the full circumference of the spout. Also, the magnet 28 need not do so. Instead, one or more pieces of magnetisable material or magnets may be provided at the individual positions, such as positions around the circumference of the spout, where the piece(s) do/does not stretch all around the periphery of the spout.

Thus, firstly, a set-up is achieved where any number of positions, such as one, two, three, four or more, may be defined, all of which may be stable positions. In the situation of the bands of magnetisable material or magnets, the stable positions are achieved with no energy consumption. Only movement between the positions requires energy.

Naturally, two positions may be an open and a closed position. Additional positions may relate to positions where the side opening 22 is open to different degrees, such as when different percentages of the area of the opening 22 are blocked, or different distances exist from the blocking element 24 and the opening 22. In one situation, the blocking element 24 may, in the blocking position, block more than one opening 22, and in the open position allow more than one opening 22 to be open, where other positions block only some of the openings while others are kept open.

In FIG. 10, a set-up is illustrated having three bands 50 and thus three stable positions. The corresponding magnetic force potential energy is seen in FIG. 9.

In fact, using the bands 50 or the like as seen in FIGS. 8-11 provides not only multi-stable positions without the use of energy, it also provides the possibility of defining stable positions for the blocking element 24 without using physical stoppers.

When the blocking element 24 is allowed to travel slightly to the left of the left-most position and slightly to the right of the right-most position (FIG. 8), the blocking element 24 may be moved between the positions with no sound/noise/vibration creation. When the blocking element 24 is brought over the potential energy peak seen in FIG. 7, it will be biased toward e.g. the right position. During the movement, the blocking element 24 may "overshoot" this position and move past the position, but as it is biased toward this position, the movement away from the position will be decelerated and stopped, where after the blocking means 24 will move back toward the position. This pendulum-like behaviour will end with the blocking element 24 at the desired, right position. This behaviour is caused by the magnets and the bands 50 (or the like) and need no stops. The movement however, requires that the blocking element 24 is allowed to move slightly past the outer positions.

In FIG. 12, compared to FIG. 5, the opening/closing is performed by a magnet 24 which is rotated around the axis of the spout 16. In addition to this rotation, the magnet 24 may also be translated along the axis of the spout 16. Again, coils 26 are provided for facilitating this movement.

In FIG. 5, the magnet 24 may extend around the full inner circumference of the spout channel in order to remain in contact with the wall. In FIG. 12, an element 24' may be attached to the magnet 24 in order to ensure that the magnet keeps engaging the wall during rotation.

In FIG. 13, portions of a sound generator are illustrated where yet another manner of creating a valve is seen. In FIG. 13, the side opening 22 in the spout 16 is blocked by an element 24 having a magnet 28 driven by a coil 26 fastened to the spout.

In this embodiment, an inner channel element 16' has been introduced to attenuate sound output from the receiver 14 before entering the opening 22. This element may be omitted if desired. Also, this element may have any length along the axis of the spout 16.

In FIG. 14, a corresponding embodiment is seen wherein the blocking element 28 is now formed by the magnet, much like the embodiment seen in FIGS. 3, 5 and 12.

It is noted that in FIG. 13, the sound channel comprising the side opening 22 does not share volume with the channel carrying the sound from the sound emitter 14. In this respect, this sound channel only has two openings, the side opening 22 and the opening to the right.

In FIG. 15, an embodiment is seen wherein the blocking element 24, in addition to the magnet 28, has an inner sleeve 24' which may engage the inner element 16' to control the movement of the blocking element 24 during translation. Then, the magnet 28 may be selected to not extend all around the inner circumference of the channel in the spout.

In FIG. 16, an alternative embodiment is seen wherein the actuator is of a piston type. Again, the closing blocking element 24 ensures that no sound can pass from the output to the right and the side opening 22.

In this figure, as in FIGS. 13 and 14, the element 16' is provided for separating the sound in the sound channel 16*a* fed by the receiver 14 and the sound in the sound channel 16*b* to/from the side opening.

In FIG. 17, an embodiment of a spout or sound channel element 16 is seen having three oblong side openings 22-1 and 22-2. The third side opening is at the back of the element. A closing element 24 is translatable along the longitudinal axis (arrow) from an open position (dot-dashed) to a closed position (dashed) where the openings are closed. It is seen that rather large openings may be closed by even a small translation, as the openings are provided at the same longitudinal position of the axis. Preferably, the openings are provided within a narrow interval along the axis so that the closing element need not be too thick. As mentioned above, the percentage of the circumference of the sound channel where the openings exist may be rather large, so that rather large openings may be provided without making closing thereof difficult.

The invention claimed is:

1. A sound channel element having a sound channel comprising a first sound opening and a side opening between the first and second openings and a closing element configured to sequentially be in a first position, in which the closing element leaves the side opening open and with a cross sectional area of at least 1 $mm^2$, and a second position, wherein the closing element blocks the side opening, the sound channel comprising an electromagnetic actuator for positioning the closing element in the first and second positions, respectively, wherein the first and second positions are positions at different positions along a longitudinal direction of the sound channel and that the closing element is movable along a longitudinal direction of the sound channel.

2. A sound channel element according to claim 1, wherein the closing element comprises an element movable within the sound channel.

3. A sound channel element according to claim 1, wherein the actuator is configured to translate the closing element in a direction at an angle to a longitudinal direction of the sound channel.

4. A sound channel element according to claim 1, wherein the closing element is shaped as a part of a tube.

5. A sound channel element according to claim 1, wherein the closing element is shaped as a part of a tube and is movable around a longitudinal direction of the sound channel.

6. A sound channel element according to claim 1, wherein at least a portion of the actuator is positioned within the sound channel and is configured to allow sound to pass through the sound channel from the first to the second opening.

7. A sound channel element according to claim 6, wherein any portion of the actuator not provided within the sound channel is positioned around the sound channel.

8. A sound channel element according to claim 1, wherein the actuator comprises one or more coils positioned around the sound channel and wherein the closing element comprises one or more magnets.

9. A sound channel element according to claim 1, wherein the closing element comprises one or more first magnets and wherein the actuator further comprises one or more second magnets or magnetisable materials attached in relation to the sound channel and positioned at a position corresponding to that of a first magnet, when the closing element is in one of the first or second the positions.

10. A sound channel element according to claim 9, wherein the closing element is configured to move at least 2% of a distance from the first position to the second position, from the one position and in a direction opposite to a direction toward the other of the first and second positions.

11. A sound channel element according to claim 9, wherein the actuator comprises multiple second magnets or magnetisable materials each positioned at different positions along a longitudinal direction of the sound channel.

12. A sound channel element according to claim 9, wherein the second magnet or magnetisable material is a magnetisable material.

13. A sound channel element according claim 1, comprising a plurality of side openings, the sound channel having a longitudinal axis and the side openings being provided at at least substantially the same longitudinal position.

14. A sound channel element according to claim 13, wherein the sound channel has an inner cross sectional shape and where the closing element has an outer cross sectional shape corresponding to the inner cross sectional shape of the sound channel.

15. A sound generator comprising a sound emitter and a sound channel according to claim 1, the sound emitter being configured to emit sound into the sound channel via the first sound opening.

16. A method of opening or closing a sound channel comprising a first sound opening, a second side opening, a side opening and a closing element, the method comprising an electromagnetic actuator moving the closing element along a longitudinal direction of the sound channel between a first position in which the closing element leaves the side opening open and a second position wherein the closing element blocks the side opening.

17. A method according to claim 16, wherein the moving step comprises supplying power to the actuator to facilitate the movement and subsequently cutting power to the actuator.

18. A sound generator according to claim 1, wherein the sound channel has a first sound channel and a second sound channel, the first sound channel extending from the first sound opening to the second sound opening, whereas the second sound channel extends from the side opening to the second sound opening.

19. A sound generator according to claim 1, wherein the closing element comprises one or more first magnets and wherein the actuator further comprises one or more second magnets or magnetisable materials attached in relation to the sound channel and positioned at a position corresponding to that of a first magnet, when the closing element is in one of the first or second the positions and wherein the closing element is configured to move at least 2% of a distance from the first position to the second position, from the one position and in a direction opposite to a direction toward the other of the first and second positions.

* * * * *